US006934501B2

(12) United States Patent
Kawai et al.

(10) Patent No.: US 6,934,501 B2
(45) Date of Patent: Aug. 23, 2005

(54) IMAGE READING APPARATUS, IMAGE READING METHOD AND ORIGINAL TRANSPORT APPARATUS

(75) Inventors: Masaaki Kawai, Minami-alps (JP); Chiaki Osada, Nirasaki (JP)

(73) Assignee: NISCA Corporation, Yamanashi-Ken (JP)

( * ) Notice: Subject to any disclaimer, the term of this patent is extended or adjusted under 35 U.S.C. 154(b) by 0 days.

(21) Appl. No.: 10/635,537

(22) Filed: Aug. 7, 2003

(65) Prior Publication Data

US 2004/0057763 A1 Mar. 25, 2004

(30) Foreign Application Priority Data

Aug. 7, 2002 (JP) ..... 2002-230568

(51) Int. Cl.[7] ..... G03G 15/00
(52) U.S. Cl. ..... 399/367; 399/370
(58) Field of Search ..... 399/367–375; 271/184–186, 902

(56) References Cited

U.S. PATENT DOCUMENTS 5,887,865 A * 3/1999 Ishimaru ..... 399/373
5,946,527 A 8/1999 Salgado et al.
6,021,305 A * 2/2000 Sato et al. ..... 399/374
6,145,834 A * 11/2000 Hirota et al.
2003/0007196 A1 * 1/2003 Ishimaru et al.
2003/0007816 A1 1/2003 Ishimaru et al.

FOREIGN PATENT DOCUMENTS

| | | |
|---|---|---|
| JP | 03-064773 | 3/1991 |
| JP | 08-274942 | 10/1996 |
| JP | 09-261417 | 10/1997 |
| JP | 11-002931 | 1/1999 |
| JP | 2000-307821 | 11/2000 |
| JP | 2001-024850 | 1/2001 |

* cited by examiner

*Primary Examiner*—Arthur T. Grimley
*Assistant Examiner*—Ryan Gleitz
(74) *Attorney, Agent, or Firm*—Manabu Kanesaka

(57) ABSTRACT

An image reading apparatus includes a transport path for transporting an original from an original tray to a reading position; a reading device for reading the original at a reading position; a determining device for determining whether the original includes a black and white image or color image; a circulating path for returning the original to the reading position without turning over the original; a discharge path for guiding the original from the reading position to a discharge tray; and selection means for selecting one of the circulating path and the discharge path. The image reading apparatus reads the same side of the original fed from the circulating path again according to a result of the determining device.

17 Claims, 16 Drawing Sheets

Fig.4 (a) Spectral Responsivity Characteristics
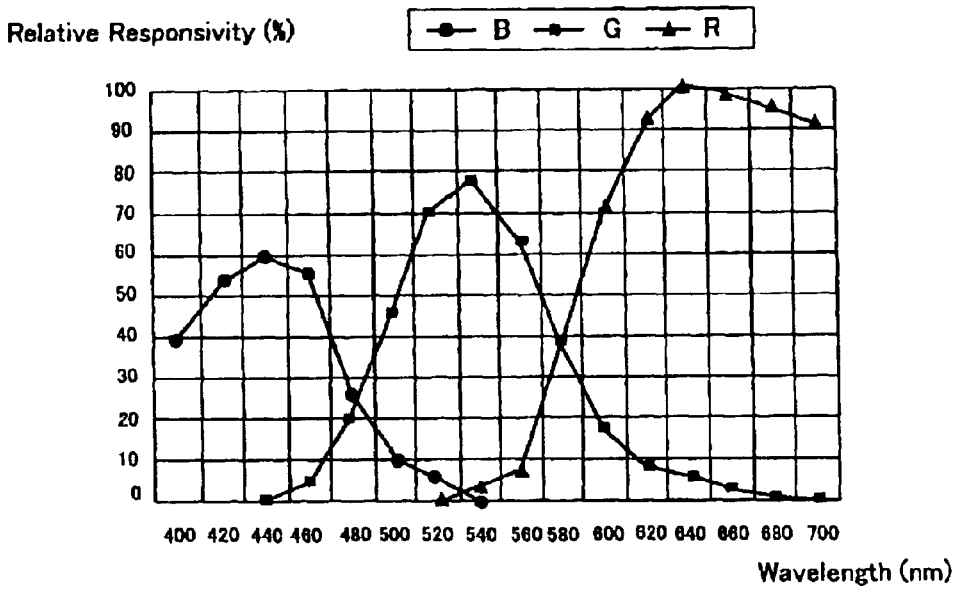
Fig.4 (b) Black/White Original Spectral Reflectance Data
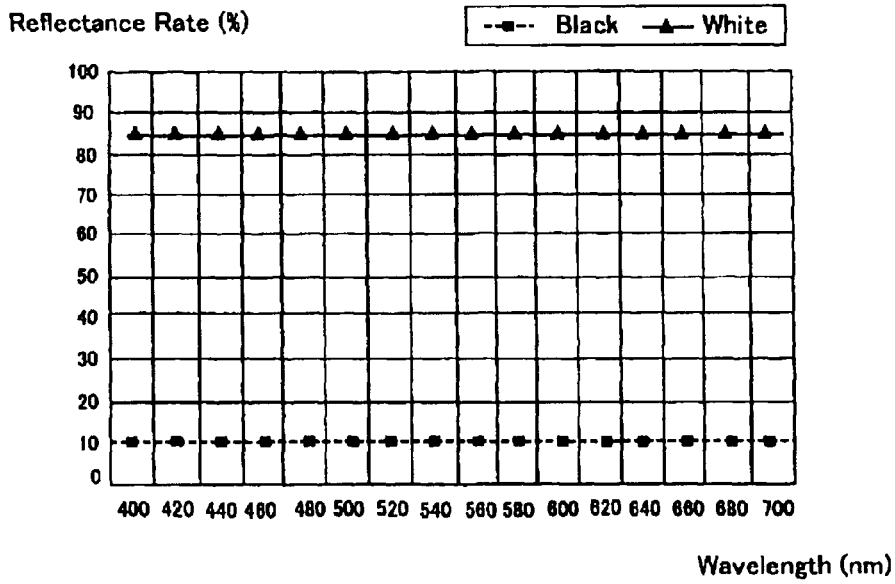

IMAGE READING APPARATUS, IMAGE READING METHOD AND ORIGINAL TRANSPORT APPARATUS

BACKGROUND OF THE INVENTION AND RELATED ART STATEMENT

The present invention relates to an image reading apparatus with an automatic document feeder apparatus (ADF) and an image reading method for reading an original transported to a platen. More particularly, the present invention relates to an image reading apparatus and an image reading method that determine whether an original to be read includes black and white images or color images, and read the images on the original according to a result of the determination.

In recent years, a computer, the Internet and electronic photos are widely used to handle color images. Accordingly, there has been an increasing demand for copying, printing, and transmitting the color images because of the superior quality as opposed to black and white images. For that reason, an image reading apparatus has been required to quickly read a color original with high quality.

However, when an image reading apparatus reads a color original, it is normally necessary to read image data for each of the three primary colors, namely red (R), green (G) and blue (B). Thus, when reading a color original with the same resolution as that of a black and white original, the image reading apparatus has to read at a speed than slower for reading a black and white original.

An image reading apparatus may read a set of originals including both color originals and black and white originals. When the apparatus reads such a set of originals in a color reading mode, a speed of reading the black and white originals will be dramatically slowed.

To solve this problem, a conventional apparatus pre-scans an original to determine whether the original has a black and white image or color image. Then, when the original has only a black and white image, the image reading apparatus reads at a comparatively high speed in a black and white mode. Conversely, when he original has a color image, the image reading apparatus uses the color reading mode with a slower speed. This system is known as the 'pre-scan/actual scan method'.

In Japanese Patent Publication (Kokai) No. 09-261417, an image processing apparatus has been disclosed as a modified version of the 'pre-scan/actual scan method'. The reading apparatus is provided with a re-circulating document feeder. It is determined if the original has a black and white image or color image for all documents on the document tray through a process of transporting the originals through a reading position inside the apparatus. Then, the apparatus stores a result for each page of the originals stacked on the original tray. Next, for the actual reading, the originals are returned to the original tray and sequentially fed in the same order. Then, the determination result is retrieved for each original, and the originals are read according to the results based on whether the original has a black and white image or color image.

An image reading apparatus disclosed in U.S. Pat. No. 5,946,527 also employs the pre-scan/actual scan method to determine whether a original is in black and white or in color by reading the original in the process to pass the original on an original tray through a reading position. Then, the original is read again according to a result of the determination.

In the image reading apparatus, it is determined whether the original fed from the original tray includes a black and white image or color image when the original passes through the reading position on the platen. In the image reading apparatus, it is possible to rotate discharge rollers in both directions for discharging the original to the discharge tray. Thus, it is possible to reverse and transport the original to the reading position again, so that both sides of the original can be placed on the reading position.

Therefore, when the original passes through the reading position for the first time, the apparatus determines whether the original has a black and white image or color image. After a leading edge of the original is discharged to the discharge tray, the discharge rollers are rotated in reverse to switchback the original. The original is turned over front to back, so when passing through the reading position for the second time, the apparatus does not read the original. After the original is switched back again on the discharge tray, when the original passes through the reading position for the third time, the image thereupon is read according to the result obtained when the original passes through the reading position for the first time. While the apparatus stores the image data, the original is discharged to the discharge tray.

In the image reading apparatus with the pre-scan/actual scan method described above, the original is transported through the same path when the original is read with only the actual scan and the original is read with both the pre-scan and the actual scan. Therefore, it is difficult to reduce a processing time when the image reading apparatus with the pre-scan/actual scan method reads a set of originals including both black and white originals and color originals.

In addition to the problems described above, the apparatus disclosed in Japanese Patent Publication (Kokai) No. 09-261417 has a large size because the original is discharged to the original tray to re-circulate through the tray. Also, it is necessary to provide a memory with a large capacity for storing the results for all the originals in one circulating operation. Furthermore, when the original is jammed during the actual scan, or some of the originals are mistakenly removed from the original tray after completing the first determination scan (pre-scan), an order of the originals is changed and the apparatus uses incorrect results for the actual scan.

The apparatus disclosed in U.S. Pat. No. 5,946,527 employs the pre-scan/actual scan method, and uses the transport path for reading both sides of the original as described above. The apparatus determines a type of original when the original passes through the reading position for the first time (pre-scan) When the original is turned over front to back and passes through the reading position for the second time, the original is not read. When the original is switched back and passes through the reading position for the third time, the apparatus reads the original (actual scan) according to the determination result in the first reading. Therefore, it is necessary to turn over the original without reading it when the original passes through the reading position. Thus, it is difficult to read the color original at a high speed, thereby taking longer to read the original.

In view of the problems associated with the prior art as described above, the first object of the present invention is to provide an original reading apparatus and original reading method capable of determining whether an original includes black and white image or color image when the original is read, thereby making it possible to read the original at a high speed.

The second object of the present invention is to provide an image reading apparatus and image reading method that can separately set a speed of reading an original to determine a type of image on the original, a speed of reading an original with a black and white image only, and a speed of reading an original with a color image only. Therefore, it is possible to optimize the reading speed for the pre-scan/actual scan and process the original at a high speed.

The third object of the present invention is to provide an original reading apparatus and original reading method in which the original transport path can be switched according to a size of the original frequently used, thereby processing the original with the frequently used size at a high speed.

The fourth object of the present invention is to provide an original reading apparatus and original reading method capable of processing an original at a high speed formed even when the original has images on both sides and one or both sides have a color image.

Further objects and advantages of the invention will be apparent from the following description of the invention.

SUMMARY OF THE INVENTION

In order to attain the objects described above, according to the present invention, an image reading apparatus comprises a transport path for transporting an original fed from an original tray to a reading position; reading means for reading the original at a reading position; determining means for determining whether the original read by the reading means includes a black and white image or color image; a circulating path for returning the original to the reading position without turning over the original from front to back after the determining means determines whether the original read by the reading means includes a black and white image or color image; a discharge path for guiding the original from the reading position to a discharge tray; and selection means for selecting one of the circulating path and the discharge path to which the original is guided from the reading position. The image reading apparatus reads the same side of the original fed from the circulating path according to a result of the determination.

In the invention, when reading an original containing both a black and white image and color image, the image reading apparatus comprises the determining means for determining whether the original has a black and white image or color image; and the selection means for selecting one of the circulating path and the discharge path to which the original is guided from the reading position. The image reading apparatus reads the same side of the original fed from the circulating path according to the result of the determination.

With the configuration described above, one of the circulating path and the discharge path to which the original is guided is selected according to the original. When the original is guided into the circulating path, it is possible to return the same side of the original to the reading position determined by the determining means without turning over from front to back. Therefore, it is possible to read the original at a high speed.

In the invention, when the determining means determines the original, the original is transported at a speed higher than a speed at which the original is transported for reading again after the original is determined to contain a color image. It is arranged to separately set the first transport speed when the determining means determines the original, the second transport speed when the original with a color image is read again, and the third transport speed when the original with a black and white image is read again. A relationship among the three transport speeds may be as follows: the second transport speed is lower than the third transport speed, and the third transport speed is lower than or equal to the first transport speed.

With this configuration, it is possible to separately set the speed of reading and determining the image on the original, the speed of reading the original with a black and white image, and the speed of reading the original with a color image, thereby making it possible to optimize a reading speed for the pre-scan/actual scan for the high speed processing.

According to the present invention, an image reading apparatus comprises reading means for reading an original at a reading position; determining means for determining whether the original read by the reading means has a black and white image or color image; original length determining means for determining a length of the original passing through the reading position in a transport direction; a switchback path for turning over the original passing through the reading position and retuning the original to the reading position after the determining means determines whether the original read by the reading means has a black and white image or color image; a circulating path for guiding the original determined by the determining means to the reading position again without turning over the original; and selection means for selecting one of the switchback path and the circulating path whether to which the original is guided and transported to the reading position according to a result of the determination of the original length determining means.

With the configuration described above, it is possible to improve a speed of processing the original with a frequently used size. Also, it is possible to effectively determine the originals to read a set of the originals at a high speed when the set includes both black and white originals and color originals.

In the invention, the switchback path may be branched from the circulating path at a downstream side of the reading position, and has a path connecting to the circulating path. Therefore, it is possible to reduce a space in the apparatus for providing the two circulating paths. When the original length determining means determines that the original has a length shorter than a predetermined length, the original is transported via the circulating path to the reading position again. On the other hand, when the original length determining means determines that the original has a length longer than a predetermined length, the original is transported via the switchback path to the reading position.

When the original is transported via the circulating path to the reading position, the reading means reads the original. On the other hand, when the original is transported via the switchback path to the reading position, the original is returned to the switchback path, and then when the original is transported to the reading position again, the reading means reads the original.

In the invention, the original length determining means may determine a length of the original in the transport direction according to data input from an external source.

According to the present invention, an image reading apparatus comprises a transport path for guiding an original on an original tray to a reading position; reading means for reading the original passing through the reading position; determining means for determining whether the original read by the reading means is a black and white original or an original with a color image; a circulating path arranged at a downstream side of the reading position for returning the original to the reading position without turning over the original; a switchback path arranged at a downstream side of the reading position for switching back the original and transporting the original to the reading position; and a discharge path for guiding the original from the reading position and discharging the original to a discharge tray. When the reading means reads both sides of the original, the original is transported through in an order of the circulating path, the switchback path and the circulating path.

Further, according to the present invention, in an image reading method, optical reading means arranged at a predetermined reading position reads an original. The image reading method comprises the steps of: determining a length of the original in a transport direction; reading the original passing through the reading position; determining whether the original has a black and white image or color image; selecting one of a switchback path arranged at a downstream side of the reading position and a circulating path to which the original is guided before the original is transported to the reading position; transporting the original to the one of the switchback path and the circulating path; setting a mode of reading the image on the original according to a result of the step of determining whether the original has a black and white image or color image; and reading the image on the original using the set mode.

With the image reading method described above, it is possible to process the original with a frequently used size at a high speed. Also, it is possible to effectively determine the originals to read a set of the originals at a high speed when the set includes both black and white originals and color originals.

In the invention, when the original length determining means determines that the original has a length longer than a predetermined length, the original is transported via the switchback path to the reading position. On the other hand, when the original length determining means determines that the original has a length shorter than a predetermined length, the original is transported via the circulating path to the reading position again.

According to the present invention, an original transport apparatus comprises a transport path for guiding an original fed from an original tray to a reading position; a circulating path for returning the original to the reading position without turning over the original from front to back after the original passes through the reading position; a switchback path for turning over the original and returning the original to the reading position after the original passes through the reading position; and selection means disposed at a downstream side of the reading position for selecting one of the circulating path and the switchback path to which the original is guided after the original passes through the reading position.

BRIEF DESCRIPTION OF THE DRAWINGS

FIG. 4(*a*) is a graph showing a relationship between relative sensitivity and a wavelength of color for each sensor, and FIG. 4(*b*) is a graph showing spectral reflectance data of a monotone original;

DETAILED DESCRIPTION OF PREFERRED EMBODIMENTS

Figure 1:
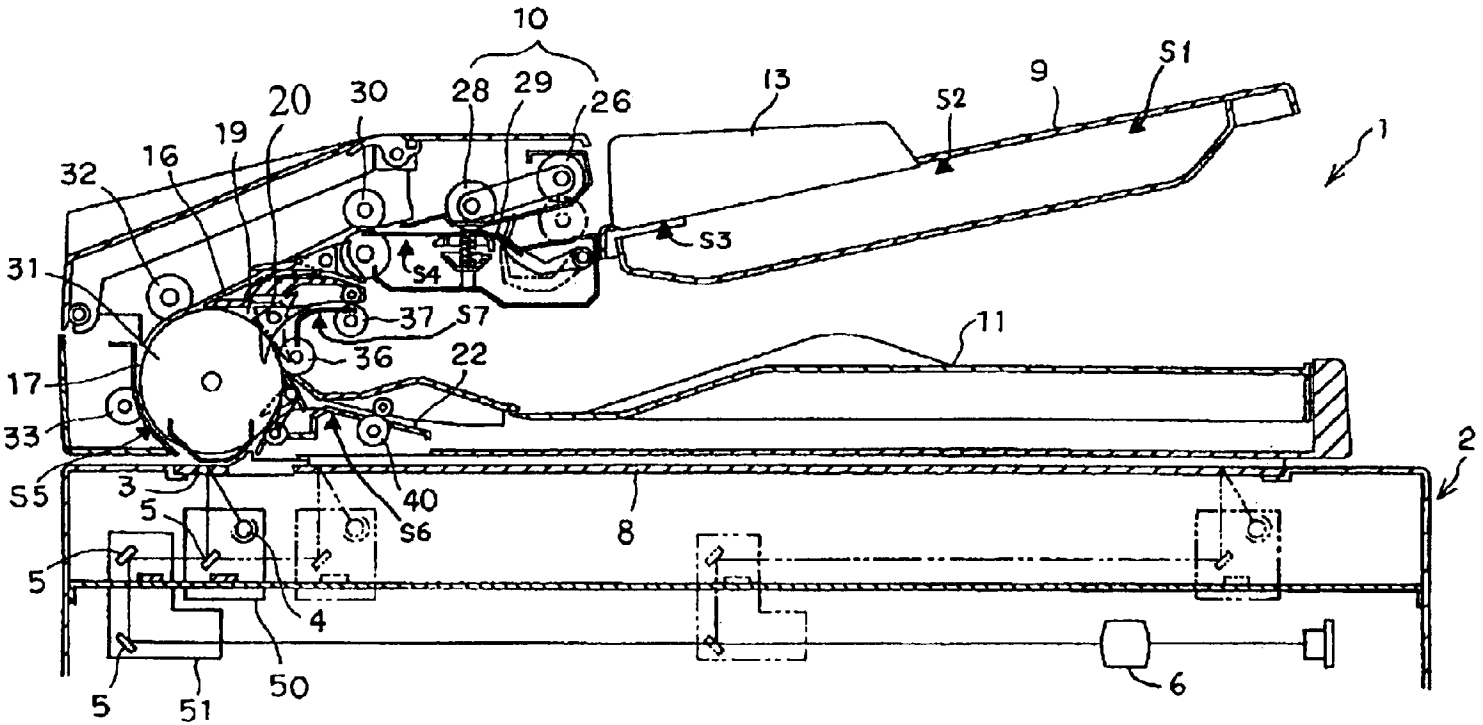
FIG. 1 is a view showing an image reading apparatus according to the present invention.
Figure 2:
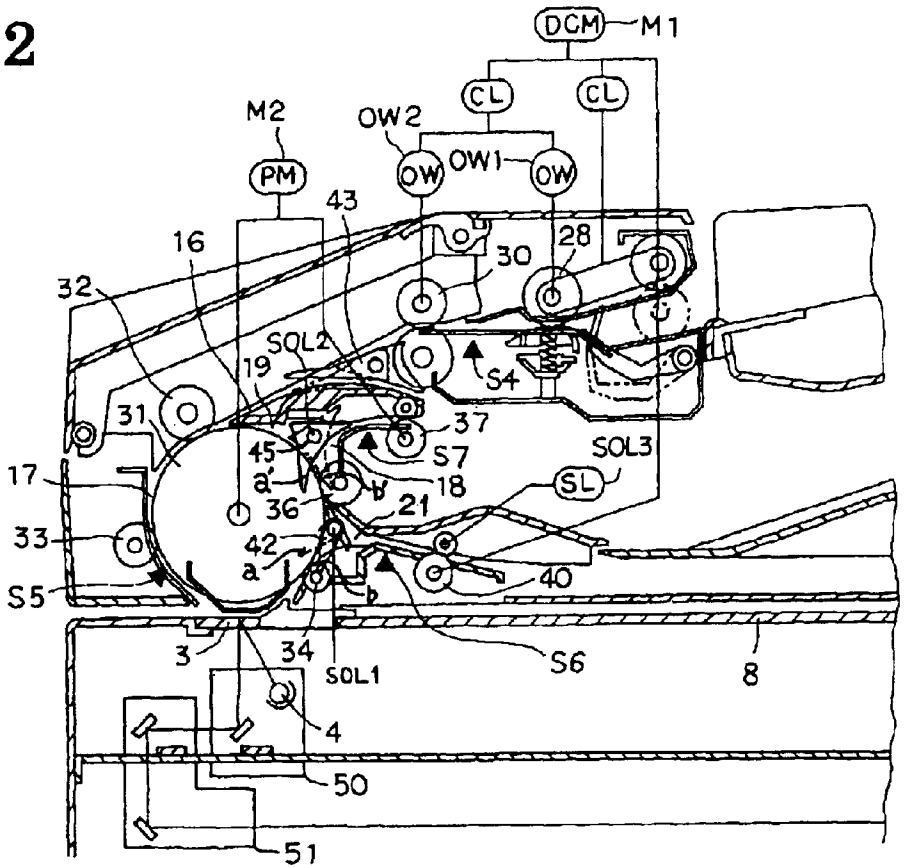
FIG. 2 is a view showing an original transport mechanism of an ADF shown in FIG. 1.

Hereunder, preferred embodiments of the invention will be described in detail with reference to the accompanying drawings. FIG. 1 is a sectional view of an automatic document feeder (hereinafter referred to as ADF) and a reading device of an image reading apparatus according to the first embodiment of the present invention. As shown in FIG. 1, the image reading apparatus is provided with the ADF 1 and the reading device 2. FIG. 2 shows an original transport mechanism of the ADF. The ADF 1 is mounted on the reading device 2 to transport an original to a top surface of the first platen 3 on the reading device 2.

The reading device 2 irradiates a transported original with light from a light source 4 such as a lamp through the first platen 3. The light reflected by the mirrors 5 forms an image on the condenser lens 6 to read the image on the original using the image sensor, i.e. reading means such as a charged couple device (CCD). Specifically, the first platen 3 is the reading position (reading unit) on the reading device 2. Also, the reading device 2 is provided with a second platen 8 with a surface area large enough to cover the entire surface of an original. The reading device 2 can read a thick original such as a book by opening the ADF 1 and placing the thick original on the second platen 8. The first carriage 50 and the second carriage 51 composed of the light source 4 and the collecting mirror 5 move in the sub-scanning direction to read the image on the thick original, via the second platen 8.

The ADF 1 is equipped with the original tray 9 for stacking a plurality of originals; supply means 10 for supplying an original stacked on the original tray 9 one at a time to a reading position; and a discharge tray 11 for storing an original discharged from the reading position.

Also, the ADF 1 comprises the sheet supply path 16 for supplying an original stacked on the original tray to a reading position on the first platen 3 one at a time; the transport path 17 connected to the sheet supply path 16 for guiding the original along the top of the first platen 3; the discharge path 18 extending from the transport path 17 and connected to the discharge tray 11; the first circulating path 19 for guiding the original from the discharge path 18 to the reading position again; the second circulating path 20 joined to the connecting potion of the sheet supply path 16 and the transport path 17 for returning the original from the discharge outlet on the discharge tray 11 to the reading position; an intermediate path 21 branching from the discharge path 18 for guiding the original from the transport path 17; and the switchback path 22 for switching back the original transported from the intermediate path 21.

In a duplex reading mode, the switchback rollers 40 nip the trailing edge of the original to read the images on both sides of the original. Then, the rollers rotate in reverse to switch back a travel direction of the original from front to back. The rollers are controlled to transport the original to the reading position on the first platen 3 via either the first circulating path 19 or the second circulating path 20.

According to the invention, the original transport means has a function for re-transporting the original to a predetermined reading position. That is, after the original is transported in the discharge direction, the original is transported again to the reading position. The original is switched back in an upstream direction opposite to the discharge direction, and transported again to the reading position.

Arranged on the sheet supply path 16 are the feed rollers 26 for feeding an original; the transport roller 28 for transporting the original fed by the feed rollers 26; the separation member 29 for allowing the transport roller 28 to transport only the uppermost single original and preventing the second and subsequent original from being fed; and the pair of register rollers 30 for sending the original transported by the transport roller 28 further downstream after aligning leading edge thereof.

The feed rollers 26 and the transport roller 28 are interconnected to the sheet supply motor M1 via the one-way clutch OW1. Also, the register rollers 30 are interconnected to the sheet supply motor M1 via the one-way clutch OW2. Through this configuration, the sheet supply motor M1 rotates the feed rollers 26 and the transport roller 28 in the forward rotation and rotates the register rollers 30 in the reverse rotation.

To the transport path 17 are arranged the large transport roller 31 and a plurality of follower rollers 32, 33 and 34 pressing against the outer circumference of the transport roller 31. The transport roller 31 is driven in forward and in reverse by the transport motor M2.

The follower roller 36 that presses against the transport roller 31, and the pair of discharge rollers 37 that discharge the original to the discharge tray 11 are arranged on the discharge path 18. The discharge roller 37 is interconnected to the transport motor M2 that can rotate in forward and in reverse. Also, as described above, below the discharge path 18 is formed the switchback path 22.

In order to transport the original without hindrance when the leading and trailing edge of the original circulating via the circulating path 19 and the transport path 17 cross each other, the pair of switchback rollers 40 on the switchback path 22 is configured so that a solenoid SOL 3 separates one of the switchback rollers 40 from the other switchback roller 40. The switchback rollers 40 are interconnected to the sheet supply motor M1 that can rotate in forward and in reverse.

At a downstream side of the transport path 17 is arranged the switchback flapper 42 to guide the original to one of the discharge path 18 and the switchback path 22. The switchback flapper 42 is driven by a solenoid SOL 1. The switchback flapper is driven to the position (a) shown in the drawings when guiding the original to the switchback path 22, and is positioned at the position (b), or a home position, when guiding to the discharge path 18.

Also, at a downstream side of the switchback flapper 42 is arranged the first discharge flapper 45 that guides the original to one of the first circulating path 19 and the discharge roller 37. The first discharge flapper 45 is driven by a solenoid SOL 2. The first discharge flapper 45 is positioned at the position (a'), or a home position, shown in the drawings, when guiding an original to the discharge roller 37, and is driven to the position (b') when guiding an original to the first circulating path 19. At this time, the original is transported while being wound around the transport roller 31. Note that when the original has a length shorter than a width of the letter size (215.9 mm), the original is transported while being wound around the transport roller 31. A free-falling flapper 43 is disposed above the discharge path 18 to move downwardly when the leading edge of the original pass through.

Further, on the original tray 9 are arranged the length sensors S1 and S2 that detect the length of the original on the original tray 9, and the empty sensor S3 that detects the original. On the sheet supply path 16 is arranged the register sensor S4. On the transport path 17 is arranged the read sensor S5; on the switchback path 22 is arranged the switchback sensor S6; and on the discharge path 18 is arranged the discharge sensor S7. These sensors are connected to the control unit (control means). Also, the sheet supply path 16 and the transport motor M2 are connected to a transport control unit (not shown in the drawings). Also, the pressure solenoid SOL1, the solenoid SOL2 and the solenoid SOL3 are connected to the control unit. The control unit has a central processing unit (CPU) for controlling a process of transporting the original.

Based on the signal output from each of the sensors S1 to S7 and the image determining means, each of the motors M1 and M2 and the solenoids SOL3 to SOL3 are controlled to execute the original transport operation by the control unit. The discharge roller 37 is interconnected to the transport motor M2 that can rotate in only one direction.

Note that in this embodiment of the present invention, the switchback path 22 is disposed as described above. The leading and trailing edges of the original are switched in the path 22 to turn the original over from front to back. It is also possible to turn the original over from front to back by inverting the discharge path 18 and the discharge roller 37, without establishing the switchback path 22. Specifically, it is possible to configure a discharge roller that can rotate in both forward and in reverse and interconnect that to the discharge roller 37.

Through this configuration, the discharge rollers 37 are controlled to rotate in reverse while nipping the trailing edge of the original when reading in the duplex mode to read images on both sides of an original, so that the original is switched back and sent to the transport path 17 via the circulating path 20. It is also perfectly acceptable to configure the pair of discharge rollers 37 to use a pressing solenoid SOL to separate a discharge roller 37 from the other discharge roller 37, so that unhindered transport of the original is possible without the leading and trailing edges thereof pass each other when the original is circulated via the first circulating path 20 and the transport path 17. Specifically, the discharge path 18 and the paired discharge rollers 37 have a function to switchback the travel direction of the original from front to back.

Figure 3:
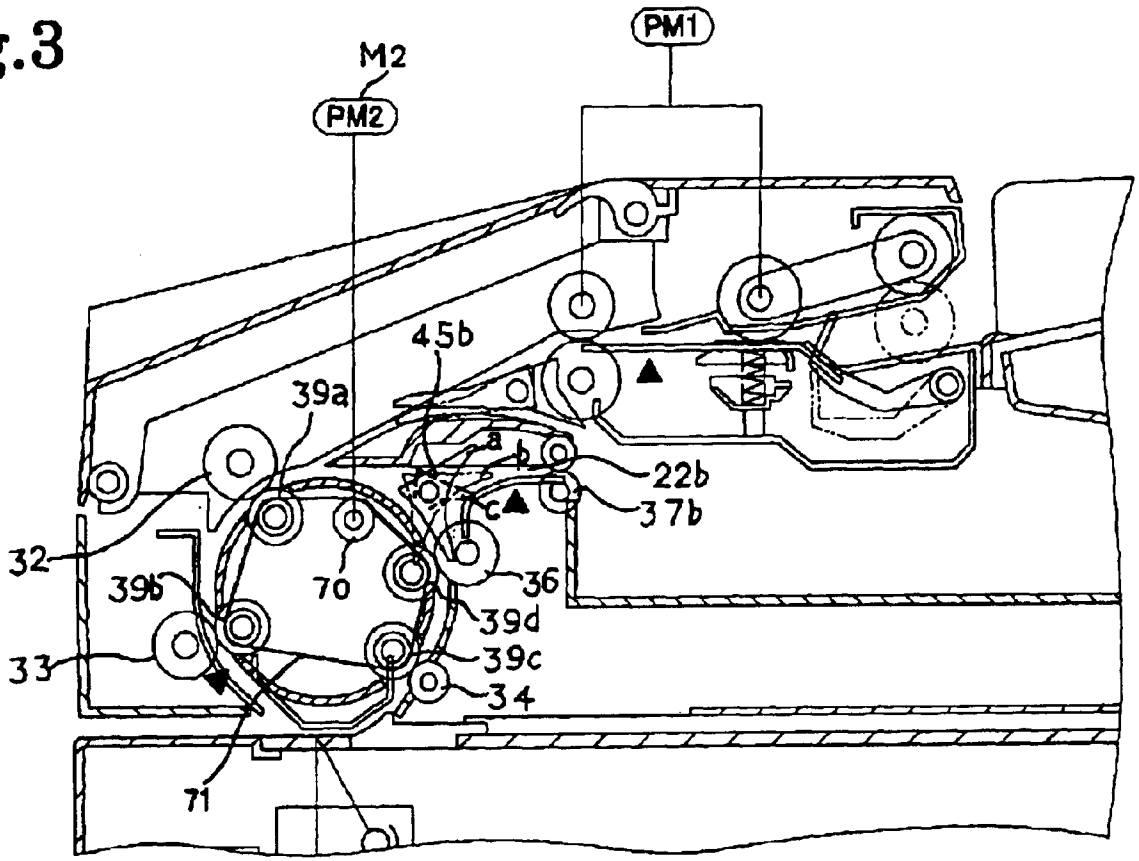
FIG. 3 is a view showing another original transport mechanism of an ADF according to the present invention.

The following will explain a reading device according to the second embodiment of the present invention. FIG. 3 shows an original transport mechanism of the ADF of the second embodiment. In the first embodiment shown if FIG. 2, the transport roller 31 is a large diameter roller. The transport roller in the second embodiment is provided with the transport rollers 39*a*, 39*b*, 39*c*, and 39*d* paired with the follower rollers of 32, 33, 34 and 36 as shown in FIG. 3.

The four transport rollers 39*a,* 39*b,* 39*c,* and 39*d* are driven by the transport motor M2 via the belt 71 trained around a drive shaft 70 and the four transport rollers 39*a,* 39*b,* 39*c,* and 39*d.* The four transport rollers 39*a,* 39*b,* 39*c,* and 39*d* are configured to press against the paired follower rollers of 32, 33, 34 and 36.

Furthermore, in the original transport mechanism, the switchback path 22*b* functions as a discharge outlet. When a large original with images on both sides is transported, the switchback operation is executed. The discharge flapper 45*b* moves and the discharge roller 37*b* rotates in forward and in reverse to discharge the original.

The discharge flapper 45*b* is moved to the (a) position when a small original is wound around for transporting, and is moved to the (b) position when the original is discharged, as shown in FIG. 3. When the original is switched back, the discharge flapper 45*b* is moved to the (c) position for guiding the original to the discharge tray 11. In such a configuration, the switchback path 22*b* and the discharge outlet are the same path, and the discharge flapper 45*b* is moved to control the transport direction of the original.

Note that the second embodiment has the configurations same as those in the first embodiment other than the configuration of the transport rollers 39*a,* 39*b,* 39*c,* and 39*d,* and the switchback path 22*b,* or the discharge outlet as described above, so that the descriptions thereof are omitted.

The following will describe a process of determining a size of the original. At first, the first method of determining an original size uses the two length detection sensors S1 and S2 disposed on the original tray 9 and the empty sensor S3 that detects the originals on the original tray 9.

When the length detection sensors S1 and S2 are off and only the empty sensor S3 is on, it is determined that the length of the original is shorter than a width of the A4 size. When the length detection sensors S1 is off and the length detection sensors S2 and the empty sensor S3 are on, it is determined that the length of the original is shorter than a length of the A4 size. Further, when the length detection sensors S1 and S2 and the empty sensor S3 are on, it is determined that the length of the original is longer than a length of the B4 size.

When the original is sent to the sheet supply path 16, the register sensors S4 arranged at an upstream side of the register rollers 30 determine the width of the original. The register sensors S4 are arranged at plural positions in the width direction of the original on the sheet supply path 16 to determine the length of the original in the width direction through on/off of each sensor. The size of the original is determined according to the detection of the length of the original in the transport direction and the width direction.

The second method of determining the original size uses the two length detection sensors S1 and S2 disposed on the original tray 9 and the empty sensor S3 that detects the originals on the original tray 9. When the length detection sensors S1 and S2 are off and only the empty sensor S3 is on, it is determined that the length of the original is shorter than a width of the A4 size. When the length detection sensors S1 is off and the length detection sensors S2 and the empty sensor S3 are on, it is determined that the length of the original is shorter than a length of the A4 size. Further, when the length detection sensors S1 and S2 and the empty sensor S3 are on, it is determined that the length of the original is longer than a length of the B4 size.

A plurality of register sensors S4 is arranged in the width direction of the original on the sheet supply path 16 at an upstream side of the register rollers 30, and determines the width of the original with the first method. In the second method, a slide volume (variable resistor), not shown in the drawings, is interconnected to the movement of the movable side plate 13 (see FIG. 1) in the width direction to regulate the side edges of the original, and rotates to determine the size of the original. The size of the original is determined according to the detection of the length of the original in the transport direction as described above, and the detection of the width of the original by the slide volume (variable resistor).

In the third method of determining the original size, the length of the original in the transport direction is determined to be shorter than a width of the A4 size when the register sensor S4 detects the trailing edge of the original (the state in which the register sensor S4 is off), and longer than a width of the A4 size when the register sensor S4 turns on, after the register rollers 30 transports the original for a predetermined distance to the read sensor S5.

A slide volume (variable resistor), not shown in the drawings, is interconnected to the movement of the movable side plate 13 in the width direction to regulate the side edges of the original, and is used to detect the width of the original. The size of the original is determined according to the detection of the length of the original in the transport direction using the register sensor S4 as described above, and the detection of the width of the original by the slide volume (variable resistor).

In the fourth method of determining the original size, the length of the original in the transport direction is determined to be shorter than a width of the A4 size when the register sensor S4 detects the trailing edge of the original (the state in which the register sensor S4 is off), and longer than a width of the A4 size when the register sensor S4 turns on, after the register rollers 30 transports the original for a predetermined distance to the read sensor S5. The register sensor S4 arranged at an upstream side of the register rollers 30 determines the width of the original.

The register sensors S4 are arranged at plural positions in the width direction of the original on the sheet supply path 16, and determine the width of the original through on or off of each sensor. The size of the original is determined according to the detection of the length of the original in the transport direction and the width of the original.

Note that to determine the size of the original, the four methods are available as described above. In this embodiment of the invention, the first method is employed. The other methods can also be employed. Furthermore, it is also perfectly acceptable to use an input from an operation panel on an external device or through an input from a personal computer to determine the size of the original.

The following will describe an image reading method according to the present invention. At first, the following will explain a method for determining whether the image to read is a black and white image or a color image.

FIG. 4(*a*) is a graph showing a relationship between relative sensitivity and a wavelength of color for each sensor, and FIG. 4(*b*) is a graph showing spectral reflectance data of a monotone original. As shown in FIG. 4(*a*), since each line sensor, R, G, and B, has a spectral sensitivity peak at a different wavelength in the reading level of the sensors, each line sensor generates an output peak value at different wavelengths when reading color originals.

On the other hand, as shown in FIG. 4(*b*), a monotone (black and white) original shows a constant spectral reflectance rate regardless of the wavelength. In the figure, each line sensor generates a constant high output for white pixels and a constant low output for black pixels. Because of this difference, it is possible to determine whether an original to be read is either in color or black and white.

Note that because it is possible to determine the image by checking the peak wavelength of the line sensor output, even when reading the original at high speed in the black and white mode, this operation is possible.

In this way, the color detection unit in this invention is configured to receive an output from a shaded correction unit converted into a digital signal at the red, green and blue line sensors. When a difference is detected in the output color patterns from the sensors, it is determined to be a color original. Conversely, when there is no difference, it is determined to be a black and white original.

In this embodiment of the invention, an image-signal control apparatus (the control unit) is provided with a data memory unit 107 (see FIG. 5 and FIG. 6) to sequentially store image data read by the reading means. Depending on the type of image reading apparatus, it is possible to output image data from the reading means to an image forming apparatus without a data memory to store the image data after processing correction of the image data. In such a case, the determining means uses the processed signal of the image data from the reading means to determine whether the image data is black and white or color.

Figure 5:
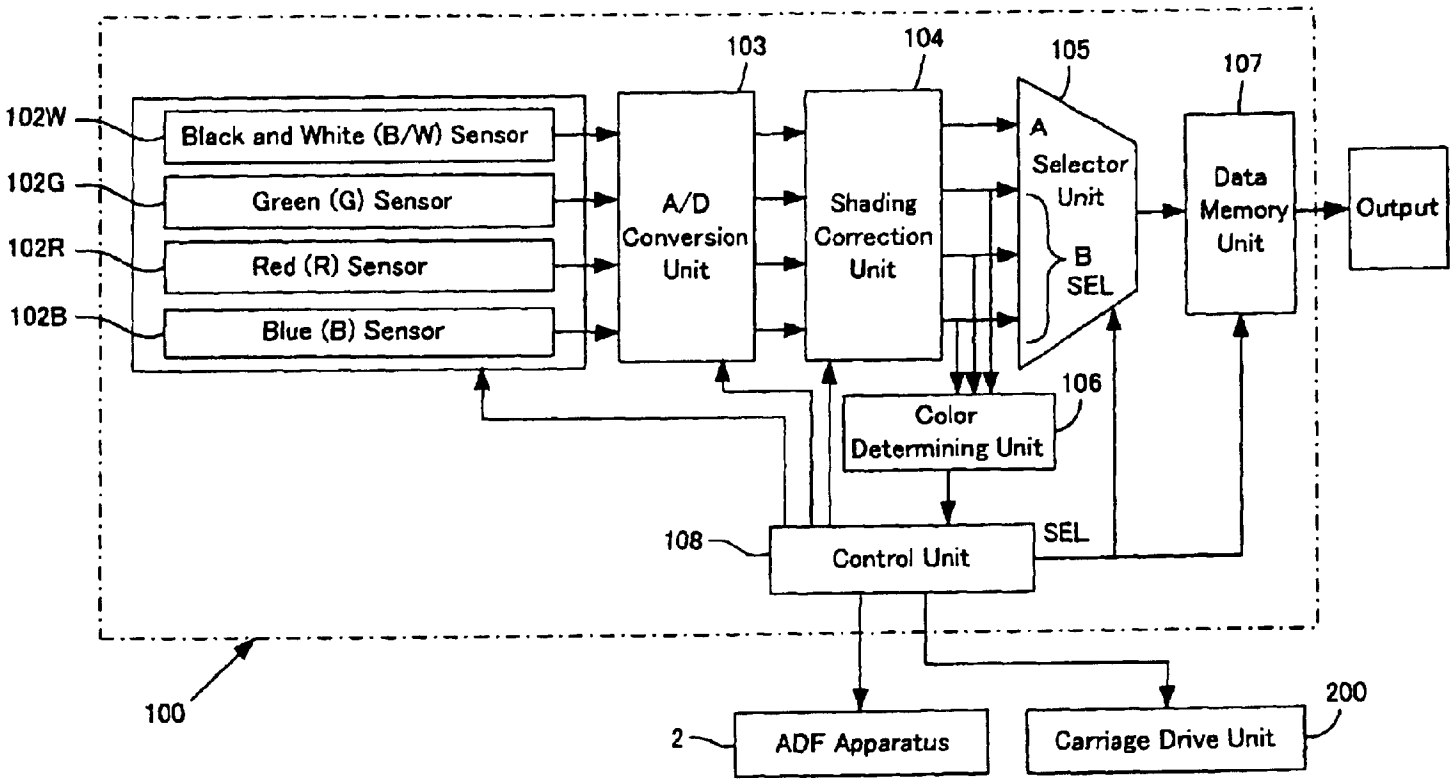
FIG. 5 is a circuit diagram of an image signal control unit with four line sensors including a black and white sensor.

FIG. 5 shows a circuit configuration of a control apparatus 100 having four line sensors, namely three line sensors of red (R), green (G), and blue (B), and a black and white (B/W) sensor. The control apparatus 100 shown in FIG. 5 includes an A/D conversion unit 103 to convert analog data read by the four line sensors 102W, 102R, 102G and 102B into digital data; and a shading correction unit 104 for correcting shading of the converted data (sensitivity correction between photoelectric conversion elements).

The control apparatus 100 also comprises a color detection unit 106 for determining a gradation of the shading corrected data; a control unit 108 for receiving a result determined by the color detection unit and outputting a signal to control the image reading apparatus; a color selector unit 105 for switching and outputting monotone data or color data according to a SEL signal from the control unit 108; and a data memory unit 107 for storing the image data after switching between a monotone mode and a color mode according to the SEL signal from the control unit 108 and outputting it to an image forming apparatus.

In the control circuit shown in FIG. 5, image data from the black and white sensor 102W are used as image data in the first reading mode (the monotone reading mode). At the same time, it is determined whether it is a color original based on the output from the green sensor 102G, the red sensor 102R and the blue sensor 102B.

Figure 6:
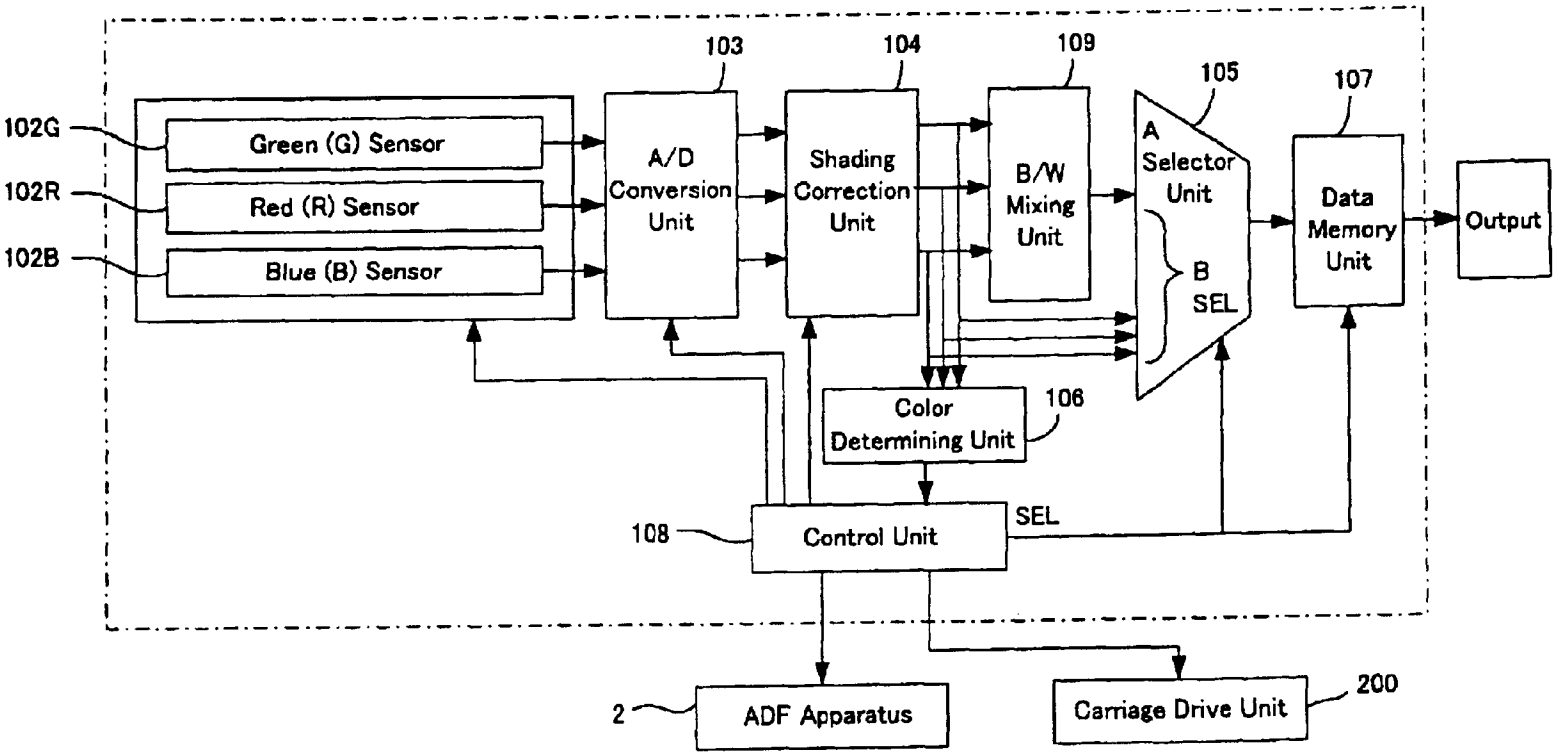
FIG. 6 is a circuit diagram of an image signal control unit with three line image sensors.

FIG. 6 shows the image-signal control unit 100*b* that uses the three line sensors of red (R), green (G) and blue (B). The image-signal control unit 100*b* comprises the line sensors 102R, 102G and 102B; an A/D conversion unit 103 for converting analog data read by the three line sensors; a shading correction unit 104 for correcting shading of the converted data; a monochrome conversion unit 109 for generating black signals based on the shading corrected data; a color detection unit 106 for determining a gradation of the shading corrected data; and a control unit 108 for receiving a result determined by the color detection unit and output a signal to control the image reading apparatus.

The image-signal control unit 100*b* also includes a color selector unit 105 for switching and output monotone data or color data according to a SEL signal from the control unit 108; and a data memory unit 107 for storing the image data after switching between a monotone mode and a color mode according to the SEL signal from the control unit 108 and outputting it to an image forming apparatus.

With the configuration described above, in the control circuit shown in FIG. 6, the image data in the first reading mode (the monochrome mode) becomes AND values of the output from the green (G), red (R) and blue (B) line sensors. Based on whether there is a difference in the output patterns from the green sensor 102G, the red sensor 102R and the blue sensor 102B, it is possible to determine whether the original is in color or black and white.

Figure 7:
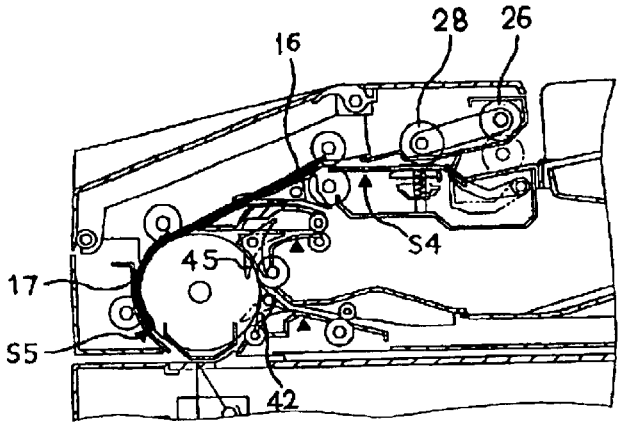
FIGS. 7(*a*)–7(*c*) are side views showing the original transport mechanism for transporting a small original.
Figure 7:
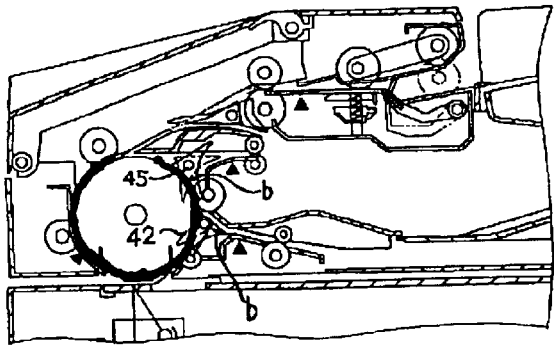
Figure 7:
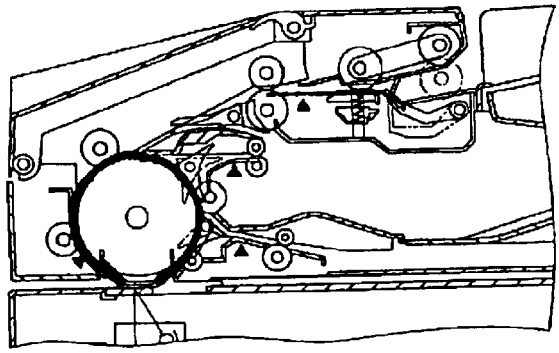
Figure 12:
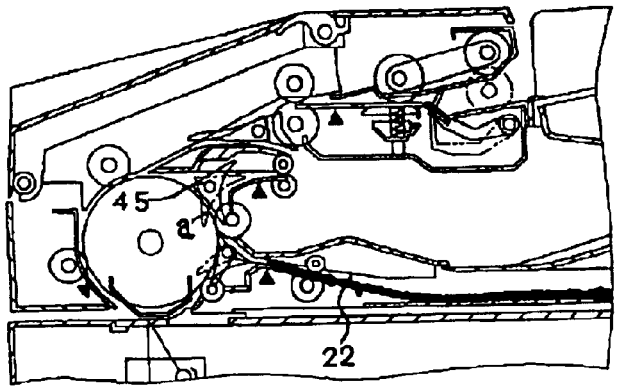
FIGS. 12(*a*) and 12(*b*) are side views showing the original transport mechanism for transporting the large original.
Figure 12:
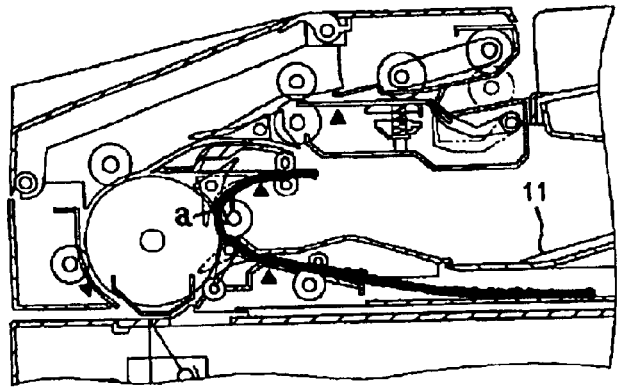

The following will describe an operation of transporting the original according to the embodiment of the present invention. FIGS. 7(*a*)–7(*c*) to FIGS. 12(*a*) and 12(*b*) are side views showing a series of operations from transporting to discharging the original in the ADF 1.

First, the operation of reading one side of a small-size original will be explained. As shown in FIG. 7(*a*), the discharge roller 26 moves downwardly to transport the original on the original tray 9. The original is separated into a single sheet by the sheet supply roller 28 and is transported to the transport path 17.

The read sensor S5 disposed on the transport path 17 and the register sensor S4 disposed on the sheet supply path 16 determines a size of the original. In the drawing, the register sensor S4 is off, i.e. the length is shorter than 215.9 mm, so that the size of the original is determined to be smaller than letter size. The switchback flapper 42 and the discharge flapper 45 are moved to the (b) positions, and the original is wound around the transport roller (for the pre-scan). The color of the image is determined at this point (See FIG. 7(*b*)).

The original is read (the actual scan) again at the reading speed based on the color determination (See FIG. 7(*c*)). The discharge flapper 45 is positioned at the (a) position and the original is discharged to the discharge tray 11 from the discharge path 18 by the discharge roller 37. (See FIG. 8(*a*))

Figure 8:
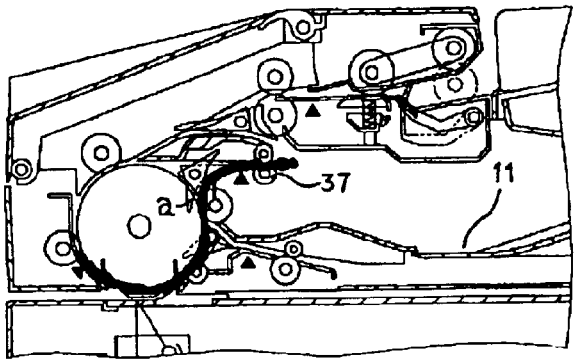
FIGS. 8(*a*)–8(*c*) are side views showing the original transport mechanism for transporting the small original.
Figure 8:
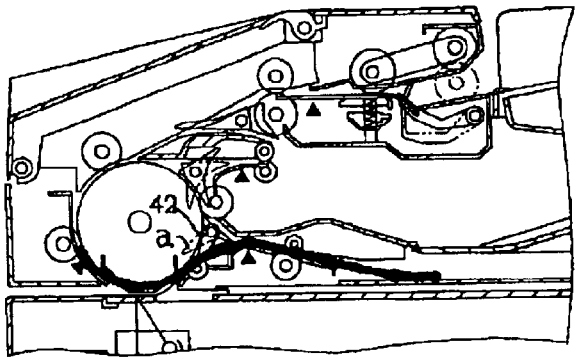
Figure 8:
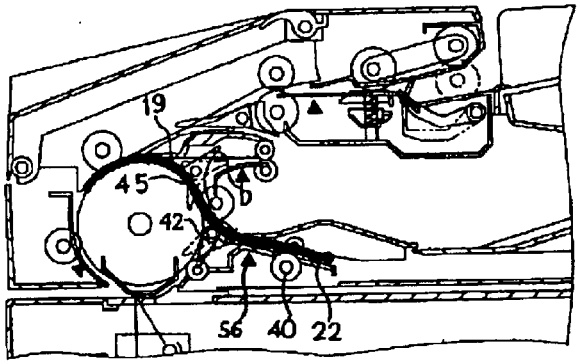

The following will describe the operation of reading both sides of a small-size original. FIG. 8(*b*) shows the operation same as that for reading the single side of the original shown in FIGS. 7(*a*)–7(*c*). After one side of the original is read, the original is guided to the switchback path 22. At this time, the switchback flap 42 is moved to the (a) position (See FIG. 8(*b*)).

When the switchback sensor S6 detects the trailing edge of the original, the switchback rollers 40 rotate in reverse to transport the original to the circulating path 19. The discharge flapper 45 at this time is moved to the (b) position (See FIG. 8(*c*)). The original is transported to the reading position, and pre-scanned. The discharge flapper 45 is positioned at the (b) position at this time. The color of the image on the original is determined during the pre-scan (See FIG. 9(*a*)). The original is read (the actual scan) again at the reading speed based on the result of the color determination (See FIG. 9(*b*)). At this time, the switchback flap 42 is moved to the (a) position.

Figure 9:
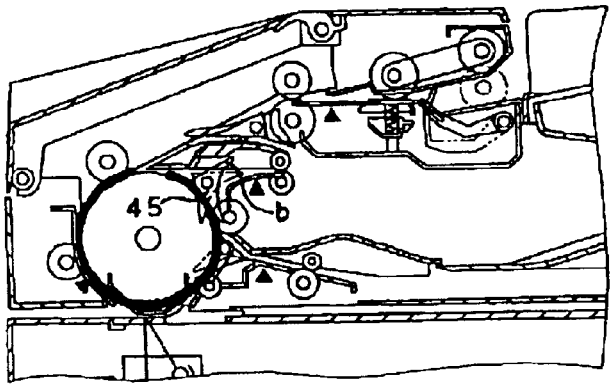
FIGS. 9(*a*)–9(*c*) are side views showing the original transport mechanism for transporting the small original.
Figure 9:
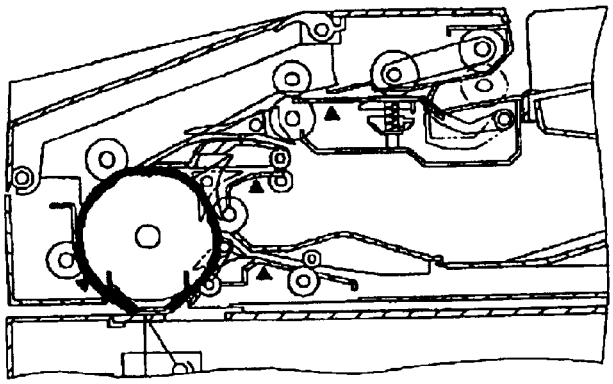
Figure 9:
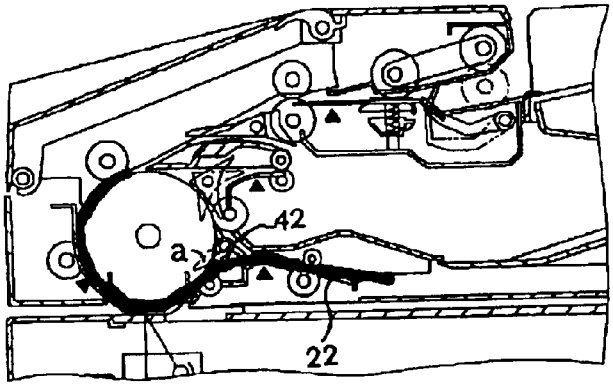
Figure 10:
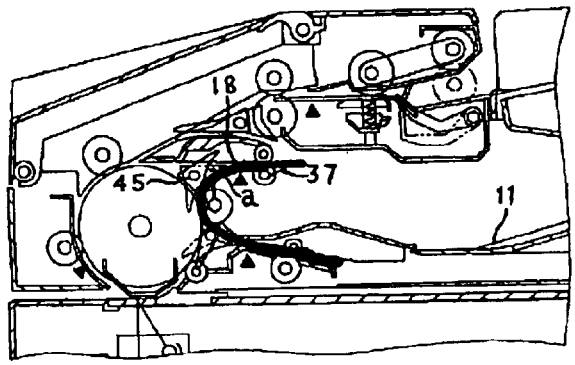
FIGS. 10(*a*)–10(*c*) are side views showing the original transport mechanism for transporting a large original.
Figure 10:
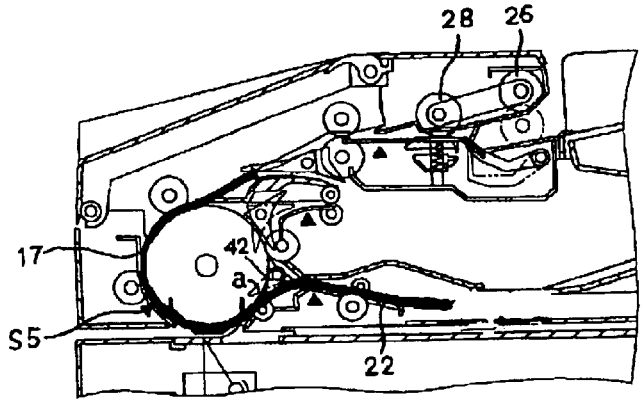
Figure 10:
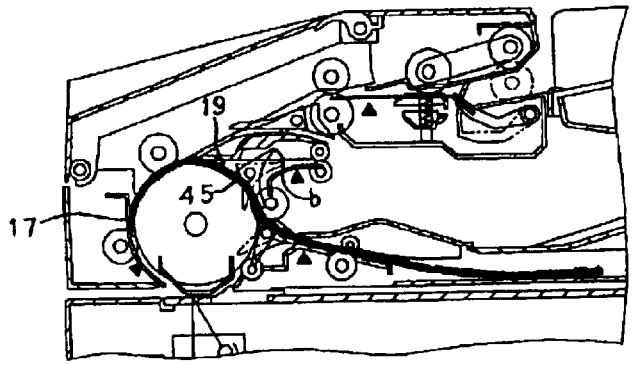

When the actual scan is completed, the original is guided to the switchback path 22 (See FIG. 9(*c*)) to turn over the original to arrange the original page order. The discharge flap 45 is moved to the (a) position. The original is then discharged to the discharge tray 11 from the discharge path 18 by the discharge roller 37. (See FIG. 10(*a*))

The following will describe the operation of reading both sides of a large-size original. The original on the original tray 9 is separated into a single sheet by the feed rollers 26 and the sheet supply roller 28, and the single sheet is transported to the transport path 17. The size of the original is detected by the read sensor S5 disposed on the transport path 17 and the register sensor S4 disposed on the sheet supply path 16. When the register sensor S4 is on, the original has a length longer than 215.9 mm, and the size of the original is determined to be larger than letter size. The switchback flap 42 is moved to the (a) position.

The pre-scanned original is transported to the switchback path 22. At this time, the color of the image is determined. (See FIG. 10(*b*)) The original is then returned to the transport path 17 via the circulating path 19. The discharge flapper 45 at this time is moved to the (b) position (See FIG. 10(*c*)).

Figure 11:
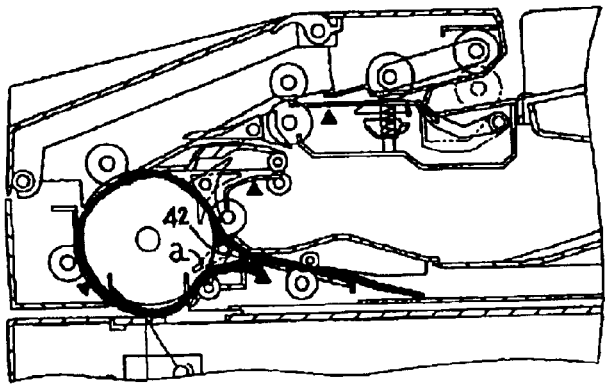
FIGS. 11(*a*)–11(*c*) are side views showing the original transport mechanism for transporting the large original.
Figure 11:
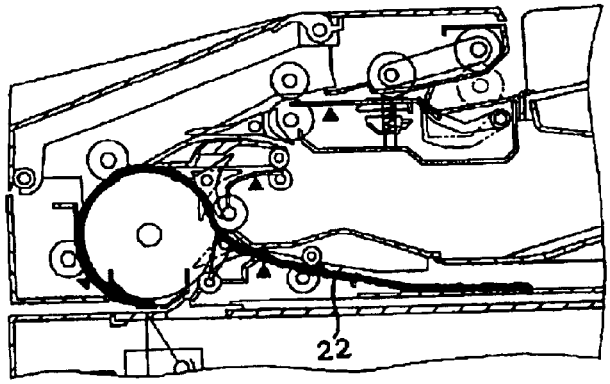
Figure 11:
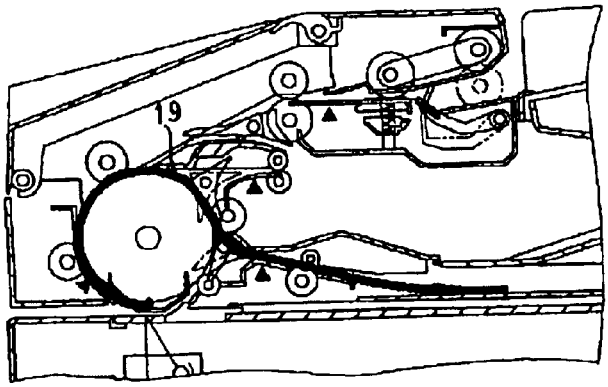

The original is transported to the reading position, and the original is not read at this time. The read side (the front side) is turned over so that the backside faces the reading position. At this time, the switchback flap 42 is moved to the (a) position (See FIG. 11(*a*)). The original is transported to the switchback path 22 again, and when the switchback is completed, the original is read at a reading speed of the reading mode determined earlier. (See FIG. 11(*b*))

After the actual scan, the original is guided to the switchback path 22 (the switchback flapper at the (a) position). When the switchback is completed, the original is transported from the circulating path 19 to the reading position to read the backside, where the color on the backside of the original is determined. (See FIG. 11(*c*)) The operation same as that of reading the front side is repeated to read the backside (See FIG. 10(*c*) to FIG. 11(*b*)).

After the backside of the original is read, the original is transported to the switchback path 22. The discharge flapper 45 at this time is moved to the (b) position (See FIG. 12(*a*)). After being switched back, the original is turned over at the discharge outlet to arrange the page order and is then discharged to the discharge tray 11 (See FIG. 12(*b*)). The operation from FIG. 10(*b*) is repeated to read the next original.

Figure 13:
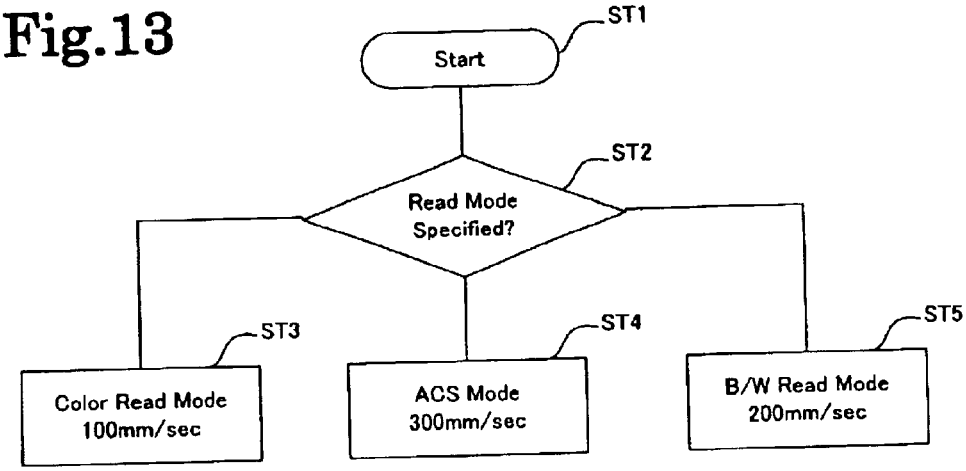
FIG. 13 is a flowchart of a process of setting a reading mode of the image reading apparatus.

The following will describe the process of reading the original according to the present embodiment with reference to the flow charts. FIG. 13 to FIG. 16 are flow charts showing the process flow. In FIG. 13, when the image reading device starts to read the original (ST1), the operator sets the reading mode (ST2). When the color reading mode is set (ST3), the image reading apparatus reads the images at a low speed in the color reading mode (100 mm/sec). If the black and white reading mode is set (ST5), the image reading apparatus reads the images at a high speed in the black and white mode (200 mm/sec). When an auto-color select (ACS) mode is set (ST4), the images are read according to the high speed ACS reading mode (300 mm/sec).

Figure 14:
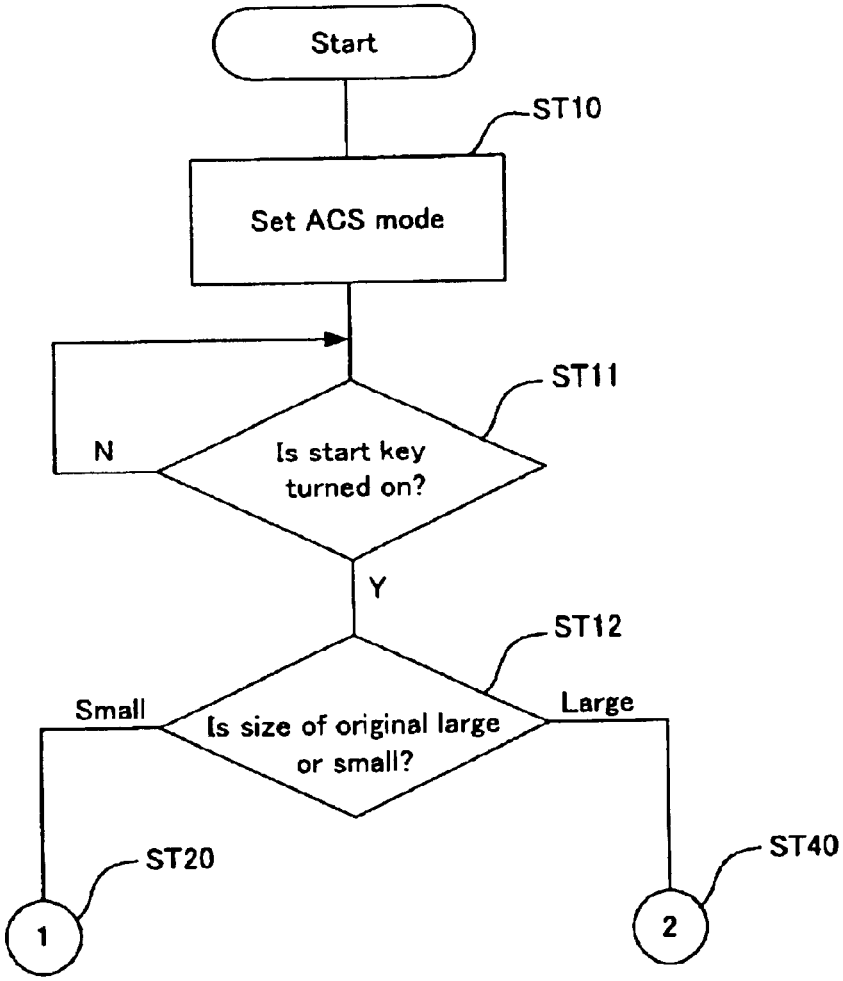
FIG. 14 is a flowchart of a process of determining a size of an original.

FIG. 14 is a flowchart of the process of determining the size of the original. The following will describe the flow chart of reading the original in the ACS reading mode. The reading mode is set to be the ACS reading mode (ST10). First, the operator presses the start key (ST11) to determine a large-size original (ST12).

Figure 15:
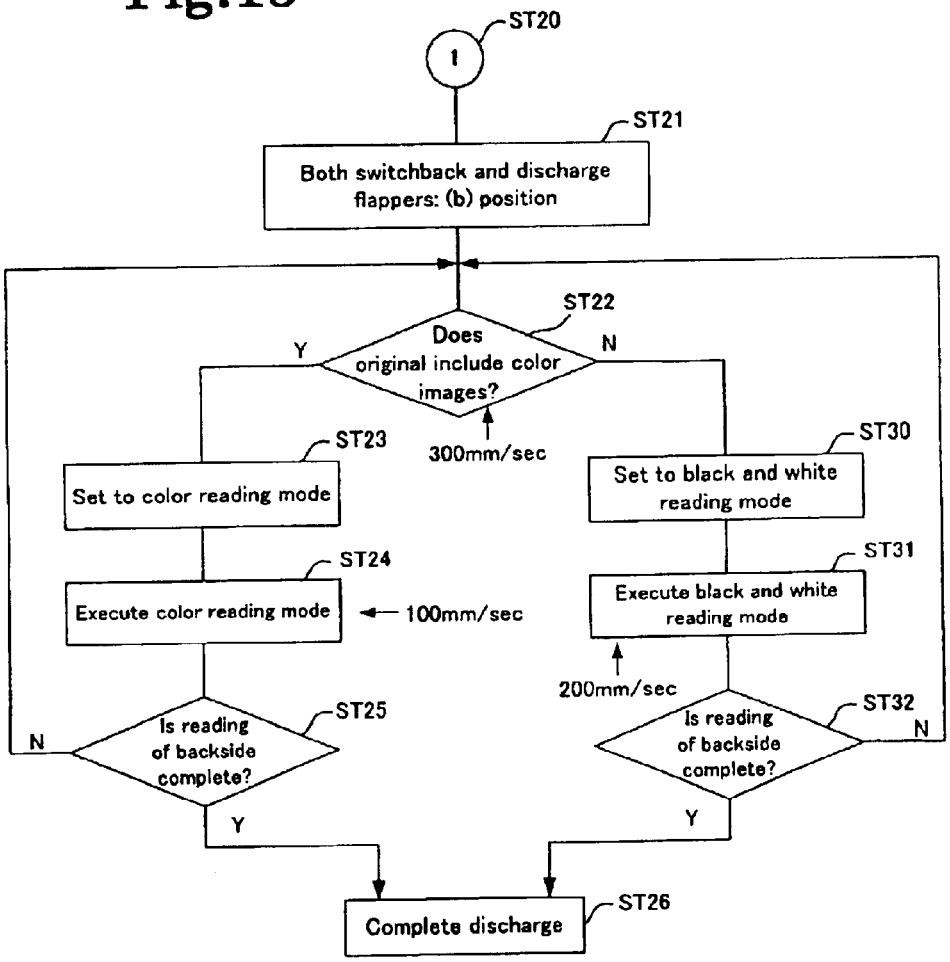
FIG. 15 is a flowchart of a process of reading an image on a small original.

FIG. 15 is a flowchart of the process of reading the image on the small-size originals. When the original is a small size (ST20), the switchback flapper 42 and the discharge flapper move to the (b) position (ST21). The pre-scan is executed at a high speed reading speed (300 mm/sec) to determine whether the original surface contains color images (ST22).

When the original contains the color images, the reading mode is set to be the color reading mode (ST23). The original is read in the color reading mode (100 mm/sec) (ST24). It is confirmed whether the backside is read or not (ST25). When the backside is read, it is determined whether the backside has a black and white image or color image at step 22. When a color image is included, step 23 (ST23) and step 24 are executed in the same manner. Then, when the backside of the original is read, the original is discharged to the discharge tray 11 (ST26).

When the original has black and white images and no color images (ST22), the reading mode is set to be the black and white reading mode (ST30). The original is read in the black and white reading mode (200 mm/sec) (ST31). After the front side is read, the backside is read from the step of determining the images on the backside (ST22) using the same steps as to read the front side. When the backside is read (ST32), the original is discharged to the discharge tray 11, and the process is completed (ST26).

Figure 16:
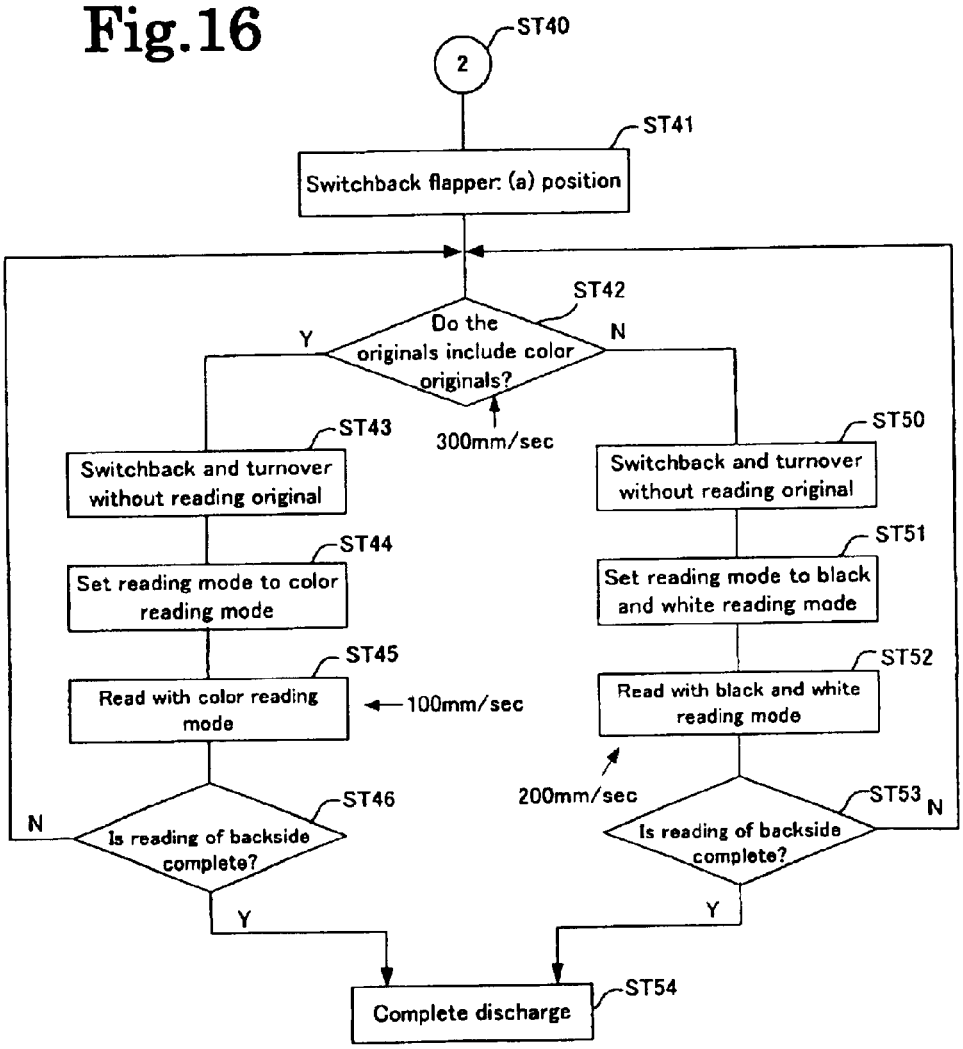
FIG. 16 is a flowchart of a process of reading an image on a large original.

Next, when the original size is determined to be large (ST12), ST40 is executed as shown in FIG. 16. FIG. 16 is a flowchart of the process of reading the image on the large-size originals. At this time, the switchback flap 42 is moved to the (a) position (ST41).

It is determined whether the front side of the original contains color images or not (ST42). The original is read at a speed 300 mm/sec. When it is determined that the original contain color images, the original is guided to the switchback flapper 42 without reading, and transported to the switchback path 22. If the original is transported to the reading position in this state, the backside is read. Therefore, the original is turned over, switched back, and turned over again to execute the actual scan at 100 mm/sec in the color reading mode (ST45).

When the front side is read, it is determined whether the backside needs to be read (ST46). When the backside needs to be read, the steps from ST42 are repeated to determine whether the original is in black and white or color images. After the backside of the original is read, the original is discharged to the discharge tray (ST54).

On the other hand, when it is determined that the original does not include color images (ST42), the original is switched back and turned over without reading (ST50). The reading mode is set to be the black and white reading mode (ST51) After the original is turned over, the original undergoes the actual scan at 200 mm/sec in the black and white reading mode (ST52).

When the front side of the original is read, it is determined whether the backside needs to be read (ST53). When the backside needs to be read, the steps from (ST42) are repeated to determine whether the backside has black and white images or color images. After the backside of the original is read, the original is discharged to the discharge tray (ST54).

As described in detail above, according to the present invention, the image reading apparatus comprises a transport path for transporting an original fed from an original tray to a reading position; reading means for reading the original at a reading position; determining means for determining whether the original read by the reading means includes black and white or color images; a circulating path for returning the original determined by the determining means to the reading position without turning over the original; a discharge path for guiding the original from the reading position to a discharge tray; and selection means for selecting one of the circulating path and the discharge path to which the original is guided. The image reading apparatus reads the same surface of the original fed from the circulating path according to the result of the determination.

In the invention, it is possible to separately set the of determining whether the original has black and white images or color images, the speed of reading the original with the black and white images, and the speed of reading the original with the color images, thereby making it possible to optimize the reading speed in the pre-scan and actual scan at a high processing speed.

In the invention, it is possible to improve the processing speed by switching the transport path for the original with a frequently used size, and by determining whether the original has black and white images or color images, and by reading the front side and backside of the original at a reading speed according to the result of the determination when reading both sides of the original, thereby making it possible to read the images at a high speed.

While the invention has been explained with reference to the specific embodiments of the invention, the explanation is illustrative and the invention is limited only by the appended claims.

What is claimed is:

1. An image reading apparatus comprising:

an original tray for placing an original, a transport path for guiding the original from the original tray to a reading position;

reading means for reading one side of the original at the reading position;

determination means for determining whether the one side of the original has a black and white image or color image;

a circulating path for returning the original passing through the reading position back to the reading position in the transport path without turning over the original;

a discharge path for guiding the original from the reading position to a discharge tray;

selection means for selecting one of the circulating path and the discharge path to which the original is guided from the reading position; and control means for always guiding the original passing through the reading position for a first time to the circulating path again so that the reading means reads the one side of the original for a second time according to a result of the determination means.

2. An image reading apparatus according to claim 1, further comprising means for transferring the original through the transport path, said transferring means transporting the original at a first speed when passing through the determining means, said first speed being higher than that of transporting the original when the reading means reads the one side of the original with the color image.

3. An image reading apparatus according to claim 1, further comprising means for transferring the original through the transport path, said transferring means providing a first speed when the original passes over the determining means for determination, a second speed when the original determined as the color image is read, and a third speed when the original determined as the black and white image is read, said first speed, second speed and third speed being set differently.

4. An image reading apparatus according to claim 3, wherein said third speed is set to be higher than the second speed, and equal to or lower than the first speed.

5. An image reading apparatus according to claim 1, wherein said control means includes a color selector unit for switching and outputting monotone data or color data according to data from the determination means, and a data memory unit connected to the color selector unit for storing the image data.

6. An image reading apparatus comprising:

reading means for reading an original at a reading position in a transfer path;

determination means for determining whether the original read by the reading means has a black and white image or color image;

original length determining means for determining a length of the original in a transport direction;

a switchback path for turning over the original passing through the reading position in the transfer path and returning the original determined by the determination means to the reading position in the transfer path;

a circulating path for returning the original passing through the reading position in the transfer path to the transfer path again without turning over the original; and selection means for selecting one of the switchback path and the circulating path according to the length of the original detected by the original length determining means so that the original is returned again to the transfer path.

7. An image reading apparatus according to claim 6, wherein said switchback path includes a branch path extending from the circulating path at a downstream side of the reading position and rejoining again to the circulating path.

8. An image reading apparatus according to claim 6, wherein said selection means selects the circulating path so that the original is transported to the reading position via the circulating path when the original length determination means determines the length of the original to be shorter than a predetermined length; and said selection means selects the switchback path so that the original is transported to the reading position via the switchback path when the original length determination means determines the length of the original to be longer than the predetermined length.

9. An image reading apparatus according to claim 6, wherein said reading means reads the original when the original is transported to the reading position via the circulating path; and said reading means does not read the original when the original is transported to the reading position for a first time via the switchback path, said reading means reading the original when the original is transported to the reading position for a second time via the switchback path.

10. An image reading apparatus according to claim 6, wherein said original length determining means determines the length of the original in the transport direction according to data input from an external source.

11. An image reading apparatus comprising:

an original tray for placing an original;

a transport path for guiding the original from the original tray to a reading position;

reading means for reading the original at the reading position;

determining means for determining whether the original read by the reading means has a black and white image or color image;

a circulating path arranged at a downstream side of the reading position in a transfer direction for returning the original again to the reading position in the transport path without turning over the original;

a switchback path arranged at the downstream side of the reading position for turning over the original and returning the original again to the reading position in the transport path;

a discharge path for guiding the original from the reading position to a discharge tray; and control means for always guiding the original to the circulating path again after the original passes through the reading position from the original tray for a first time and the determining means determines one side of the original so that the reading means reads the one side of the original for a second time according to a result of the determination means, said control means guiding the original to the switchback path after the reading means reads the one side of the original for the second time so that the original is turned over and sent to the reading means to determine the other side of the original for a first time by passing through the reading position, said control means always guiding the original to the circulating path again after the determining means determines the other side of the original by the first time so that the reading means reads the other side of the original for a second time according to a result of the determination means.

12. An image reading apparatus according to claim 11, wherein said control means includes a color selector unit for switching and outputting monotone data or color data according to data from the determination means, and a data memory unit connected to the color selector unit for storing the image data.

13. An image reading method for reading an original, comprising the steps of:

determining a length of the original in a transport direction;

reading the original passing through a reading position in a transport path;

determining whether the original has a black and white image or color image;

selecting one of a switchback path and a circulating path arranged at a downstream side of the reading position according to the length of the original determined;

transporting the original to the reading position in the transport path again via the one of the switchback path and the circulating path;

setting a mode of reading the original according to a result in the step of determining whether the original has a black and white image or color image; and reading the original again using the set mode.

14. An image reading method according to claim 13, wherein in the step of selecting, the switchback path is selected so that the original is transported to the reading position via the switchback path when the length of the original is determined to be longer than a predetermined length; and the circulating path is selected so that the original is transported to the reading position via the circulating path when the length of the original is determined to be shorter than the predetermined length.

15. An original transport apparatus comprising:

an original tray for placing an original;

a transport path for guiding the original from the original tray to a reading position;

a circulating path for returning the original to the reading position in the transport path without turning over the original after passing through the reading position;

a switchback path for turning over the original after passing through the reading position and returning the original to the reading position; and selection means disposed at a downstream side of the reading position in a transfer direction for selecting one of the circulating path and the switchback path to guide the original.

16. An original transport apparatus according to claim 15, wherein said circulating path and said switchback path are connected to the transport path at an upstream side of the reading position in the transfer direction.

17. An original transport apparatus according to claim 16, wherein said selection means selects one of the circulating path and the switchback path according to a length of the original in a transport direction.

* * * * *